US005295382A

United States Patent [19]

Fuhrman

[11] Patent Number: 5,295,382

[45] Date of Patent: Mar. 22, 1994

[54] COLD EXTRUSION OF EXTERNALLY TOOTHED HELICAL MEMBERS

[75] Inventor: William J. Fuhrman, Bloomfield Hills, Mich.

[73] Assignee: Ford Motor Company, Dearborn, Mich.

[21] Appl. No.: 880,919

[22] Filed: May 11, 1992

[51] Int. Cl.[5] ..... B21K 1/30

[52] U.S. Cl. ..... 72/343; 29/893.34

[58] Field of Search ..... 72/253.1, 260, 343, 72/467, 358, 359; 29/893.34

[56] References Cited

U.S. PATENT DOCUMENTS 3,599,469 8/1971 Bassoff ..... 72/467
3,910,091 10/1975 Samanta .
4,622,842 11/1986 Bachrach et al. .
4,878,370 11/1989 Fuhrman et al. ..... 72/260

FOREIGN PATENT DOCUMENTS 273538 11/1988 Japan ..... 72/343

*Primary Examiner*—Lowell A. Larson
*Attorney, Agent, or Firm*—Joseph W. Malleck; Roger L. May

[57] ABSTRACT

An internally toothed die which has the entire root to pitch diameter of its die tooth tip material removed in the transition zone between the land area and the trailing relieved portion; this essentially redistributes the extrusion bending forces without sacrificing helical workpiece guidance, dimensional control, or surface integrity during extrusion of an externally helically toothed gear. It provides a relieved portion that has a leading scallop with a spherical radius and a trailing portion that is linear but tangent to the spherical radius.

13 Claims, 4 Drawing Sheets

COLD EXTRUSION OF EXTERNALLY TOOTHED HELICAL MEMBERS

BACKGROUND OF THE INVENTION

1. Technical Field

This invention relates to the art of cold extrusions of externally toothed helical members, such as helical gears, and more particularly to techniques for extending the fatigue life of dies used to carry out the extrusion.

2. Discussion of the Prior Art

The original process to cold form helical external gear teeth to near net shape was developed during the early 1970's (see U.S. Pat. No. 3,910,091) and was initially used to make planet pinions useful in automatic transmissions for automotive and truck applications. This process replaced slower and more costly conventional machining of gear teeth such as by metal cutting hobbing methods.

To produce more acceptable workpiece quality, including less shape variability and greater die life, the die must have internal teeth which have a contoured entrance face and relatively thin die tooth tip thickness, which tip is linearly relieved at a trailing position (such as disclosed in U.S. Pat. No. 4,622,842). Unfortunately, such internal teeth configurations provide for an acceptable die life (meaning greater than 50,000 or more extruded blanks through such die) only if the aspect ratio (height/width ratio) of the tooth profile remains less than about 1.5. At greater aspect ratios, the die life deteriorates rapidly due to excessive torsional loading and bending of the tooth tip at the beginning or transitional zone of the relieved portion, thus causing breakage. High aspect ratios are desirable in many new gear designs because they promote a quieter, smoother action and thus this problem must be overcome.

It is an object of this invention to reduce the bending load on internal die teeth having large aspect ratios and an accompanying thin die tooth tip; the reduction should take place by directing the loading to the stronger tooth base away from the thin tooth tip or vulnerable land-to-relief transition zone.

SUMMARY OF THE INVENTION

The invention is a die which has the entire root to pitch diameter of its die tooth tip material removed in the transition zone between the land area and the trailing relieved portion; this essentially redistributes the extrusion bending forces without sacrificing helical workpiece guidance, dimensional control, or surface integrity during extrusion. It promotes a deeper relieved portion much more early in the extruding path than has heretofore been utilized by the prior art. As a first aspect, this invention is an internally toothed die for forming helical externally toothed gears, comprising: (a) a body having a cylindrical inner surface provided with generally longitudinally extending helically arranged die teeth circumferentially indexed apart, each tooth having involuted side flanks and an aspect ratio greater than 1.5; (b) dedendum forming means joining said flanks on each die tooth and which means is radially inwardly and curvilinearly relieved for at least a portion of said means to eliminate concentrated bending stresses while maintaining helical workpiece guidance, dimensional control, and surface integrity.

The relief has a leading scallop with a spherical radius and a trailing portion that is linear but tangent to the spherical radius.

As a second aspect, the invention comprises a method of making an extruded helical externally toothed gear, comprising the steps of: (a) forming an internally toothed extruding die with helical die teeth, each tooth having the dedendum forming section curvilinearly relieved to about the pitch diameter of the tooth adjacent the entry, and linearly relieved thereafter; (b) forcing a blank through the extrusion die to a semi-completed stage, the extrusion die being effective to redirect extrusion forces on the die teeth downstream of the entry and land region where full tooth height is formed in the blank, the redirection being agressively closer to the base of each tooth the more remote the die tooth section is from the land region where die tooth helix and profile would be subjected to bending stresses resulting from axially directed extrusion forces; (c) using a second blank to force the semicompleted first blank completely through the extrusion die.

DETAILED DESCRIPTION AND BEST MODE

Figure 1:
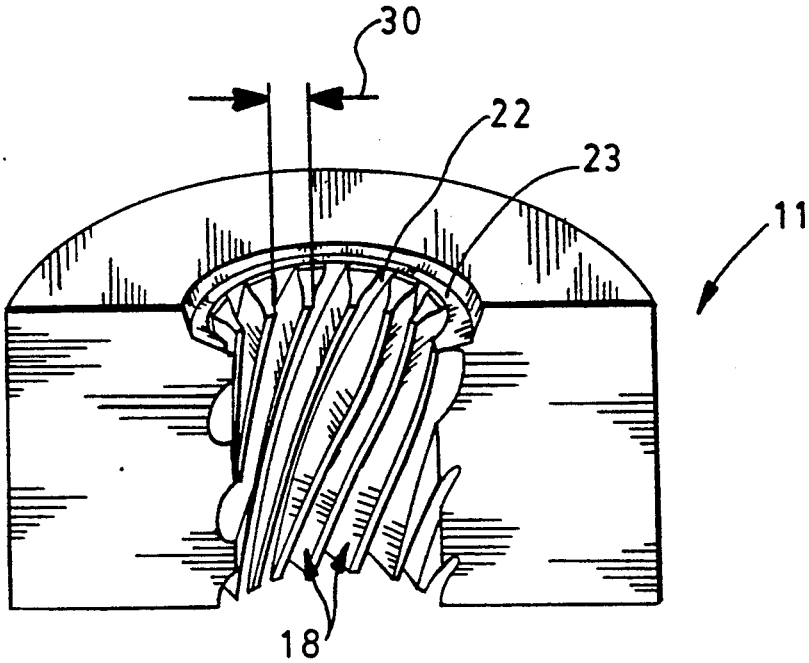
FIG. 1 is a sectioned perspective view of a die having internal helical teeth configured in accordance with this invention.
Figure 2:
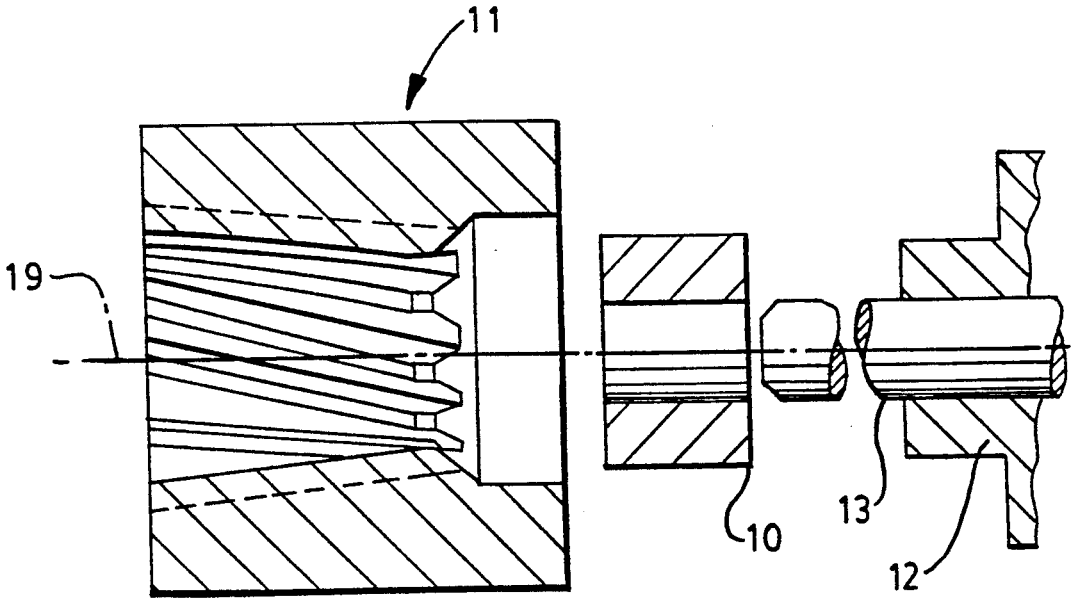
FIG. 2 is a sectional view of the die of FIG. 1 arranged for carrying out extrusion and showing a metal blank ready for extrusion.
Figure 3:
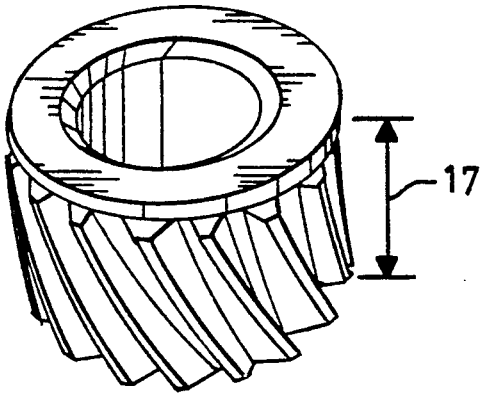
FIGS. 3–5 are sequential perspective views showing the manufacturing progress of the metal blank during extrusion and final face finishing.
Figure 4:
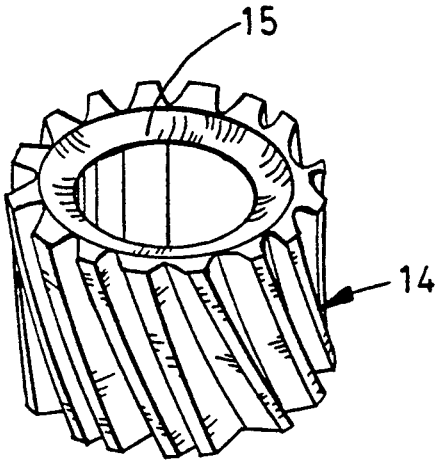
Figure 5:
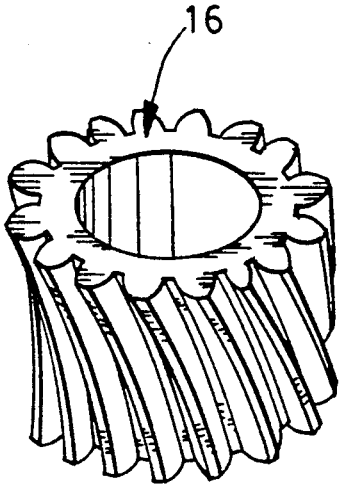

As shown in FIGS. 1–2, cold extrusion of externally toothed helical gears to near-net-shape, such as a planet gear for an automotive automatic transmission, in accordance with this invention, takes place by forcing a workpiece or metal blank 10 through the convolutions of an internally toothed die or ring 11. The forcing is carried out by using a punch 12 that has a pressed-in mandrel 13 entering the annular space within the die ring (as shown in U.S. Pat. No. 4,878,370). As the punch 12 is advanced, the workpiece 10 is extruded throughout a major portion 17 of its axial length resulting in a partially formed gear blank as shown in FIG. 3. The punch then is withdrawn to permit entry of a second workpiece in registry with the first workpiece in end-to-end relationship. The second workpiece is received over a mandrel portion 13 of the punch. Subsequent movement of the punch advances the second workpiece, which in turn advances the partially extruded gear blank until the latter is fully extruded and moved beyond the location of the external die teeth of the die. This results in an extruded gear 14, as shown in FIG. 4, having the trailing end face 15 lipped at each tooth profile. A flat face-finishing machining operation is carried out to eliminate such lips, as shown in FIG. 5, producing a flat gear end 16.

Figure 6:
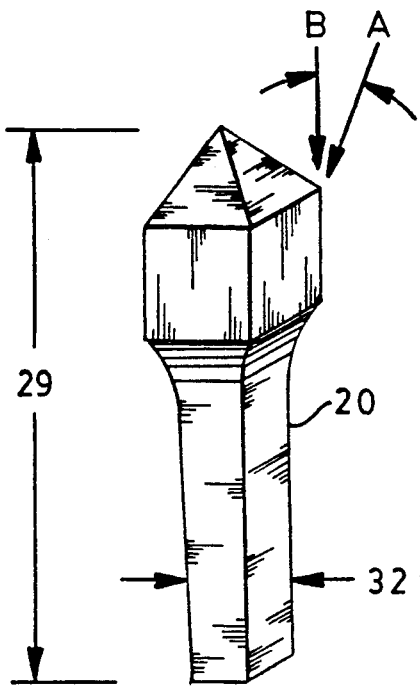
FIG. 6 is an outline of the base boundary of a typical tooth of the die of FIG. 1.

The central die 11 has a series of convolutions formed in its internal cylindrical opening; these convolutions create die teeth 18, each having its longitudinal extent helically arranged about the central axis 19 of the die. The helix angle is desirably in the range of 20°-25°. Each die tooth 18 has a base 20 (outlined in FIG. 6) which represents the intersection of the tooth body 21 with the internal cylindrical wall 22. The die teeth are circumferentially and uniformly indexed apart, at 30, a distance of about 0.20", which distance creates a throat entrance between the teeth. The entry of the workpiece or gear blank 10 into the entrance portion 23 of the die teeth is facilitated by a ramp portion 24 at the leading portion of each die tooth; such ramp is angled in the range of 20°. The full tooth profile forming region 25 of the internal die teeth is constituted as involuted side flanks 26 and 27 which converge toward a crest 28. Such region 25 is only a fraction of the total die tooth length 29. The side flanks 26 and 27 are called lands, which may have an axial length of about 0.10". Line A, at the base of the tooth, is generally parallel to the central axis 19 of the die. Line B, at the base of the tooth, is parallel to the helix. The angle C, the included angle defined by the intersection of lines A and B, is the helix angle which typically is in the range of 20°-25°. The tooth region 31, downstream of the profile forming region 25, is recessed to accommodate and guide helix formation while accommodating bending stresses. This, in conjunction with the progressively decreasing tooth thickness 32, permits the die teeth to guide the workpiece 10 during the extrusion process while avoiding excessive friction between the teeth of the die and the metal that is being extruded at the external diameter region of the workpiece. The dedendum forming means 33, for the resulting gear, comprises the tooth crest 28 which joins the side flanks 26, 27.

It has been shown by extensive laboratory and production pilot line testing that the internally toothed die for such an extrusion, especially when designed and manufactured with a linearly or straight tapered tooth relief in region 31, produces acceptable gear quality and die life only when the height-to-thickness aspect ratio is 1.45 or less. This acceptable workpiece quality and die life is represented by failure-free die life beyond 50,000 pieces.

When the die tooth profile is designed with an aspect ratio of 1.5 or more, and coupled with certain combinations of pressure, angle, and diametrial pitch which result in die tooth crest thicknesses as small as 0.050 inches, the die life is drastically reduced by early tooth fatigue failure. Such failure is concentrated immediately adjacent to the lands 26, 27 where tooth relief is originated. More specifically, failure never occurs in the very short land area wherein full tooth depth is generated, regardless of maximum extrusion forces concentrated in this region. The high compressive loading in all directions fully supports the land region teeth from bending stress and fatigue. Unfortunately, as the helical extrusion workpiece progresses into the die relief area, torsional loading and die tooth bending occurs. It is in this region that a bending load on the die tooth must be reduced and suitably directed toward the stronger base section of the tooth.

Figure 11:
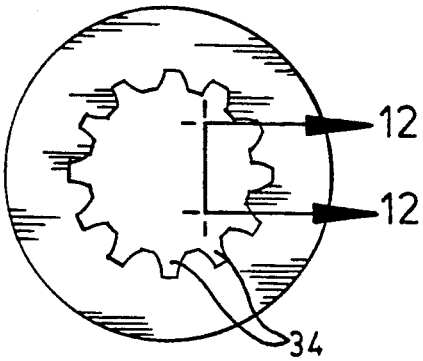
FIG. 11 is a top plan view of a prior art die having a tooth aspect ratio less than 1.45.
Figure 12:
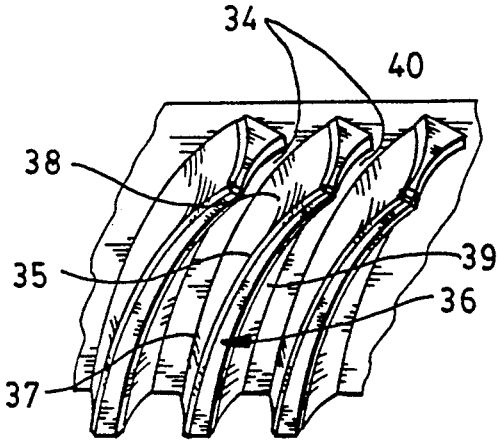
FIG. 12 is a partial radial, taken substantially along line 12—12 of FIG. 11.

Torsional loading occurs abruptly as the metal of the blank is helically turned beyond the throat area 34, as seen in FIGS. 11 and 12 for prior art extrusion of gear teeth with aspect ratios less than 1.45. As the workpiece metal is turned, the load reaction is immediately directed against the beginning relieved portion 35 of the tooth 36 (at the trailing end of flanks 38, 39 for the tooth profile forming region 40. Such load is not directed at the base 37 of the section of the tooth, but rather at the transition section 35 which is leading the relief. The transition section (which becomes the root or dedendum of the gear tooth) undergoes no relief during die formation. If such transition section is thin due to use of aspect ratios greater than 1.5, bending loads will cause stress cracks at this location.

Figure 13:
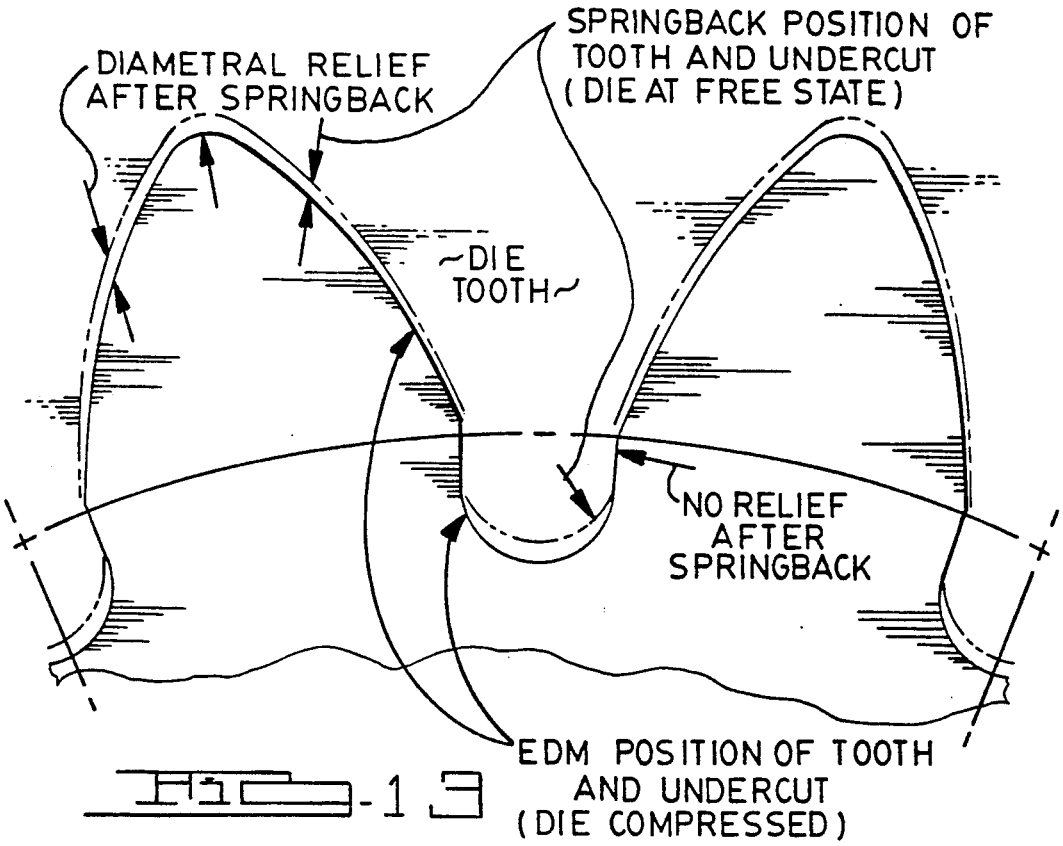
FIG. 13 is a greatly enlarged sectional view of a portion of the extruded gear teeth and die teeth, showing both the die while in a constrained condition and also in its condition after the die is removed with accompanying metal springback.

This was discovered during a review of the established die manufacturing process for introducing the required tooth relief in the vulnerable land-to-relief transition zone. This condition is inherent with the preferred method of manufacturing a taper-relief extrusion die by the EDM process disclosed in U.S. Pat. No. 4,287,749, commonly assigned to the assignee herein. In such process, the die is compressed partially into a restricting ring. During the stage in this process where the die is disassembled from the ring, the die springs back to its free state, resulting in a tapered pitch diameter which serves as the relief section below the land region. During the making of such die, the shape and dimension of the EDM electode closely simulates the size and helix angle of the workpiece extrusion and includes normal provisions for involute profile undercut below the formed diameter. This undercut accommodates root clearance during subsequent final finishing of the workpiece tooth flanks by conventional gear shaving or rolling processes. To produce this workpiece root undercut, the EDM electrode root is machined as a simple parallel sided groove below the formed diameter as illustrated in FIG. 13. During manufacturing, the expected tooth thickness relief after the EDM forming is produced quite satisfactorily once the die is removed from the restricting ring and springs back diametrically to its free state as depicted in FIG. 13. However, it is obvious from the figure that such diametric springback introduces no thickness change and therefore no relief at the root (dedendum) groove since its width remains constant regardless of the diametric flexture.

Figure 7:
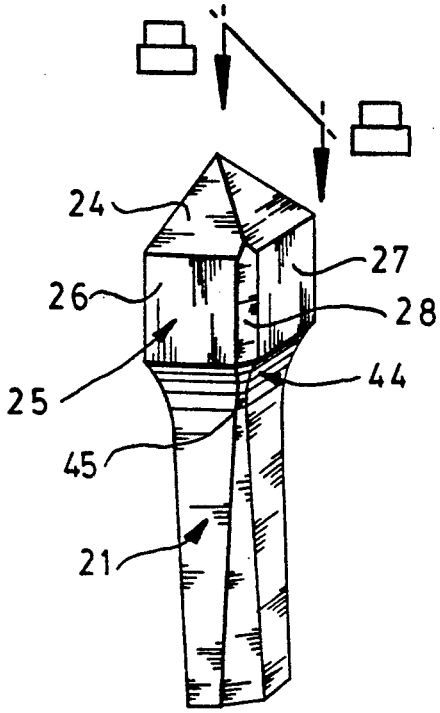
FIG. 7 is a perspective sketch of the tooth profile on the base boundary of FIG. 7.
Figure 8:
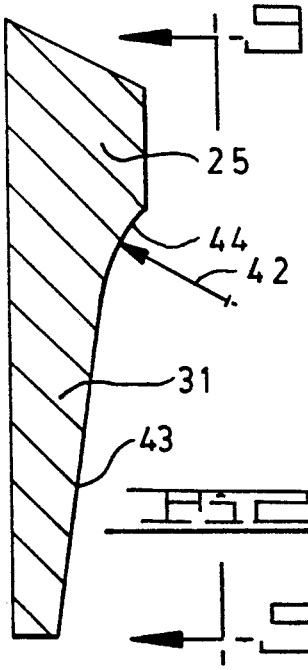
FIG. 8 is a sectional view taken substantially along plane 8—8 of FIG. 7 showing particularly the unique contour of the dedendum tip.
Figure 9:
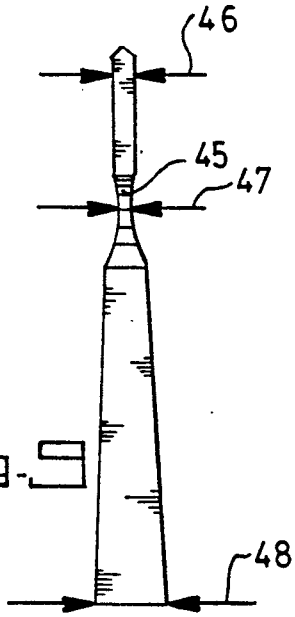
FIG. 9 is a frontal view of the exposed dedendum tip surface taken along the direction 9—9 of FIG. 8.
Figure 10:
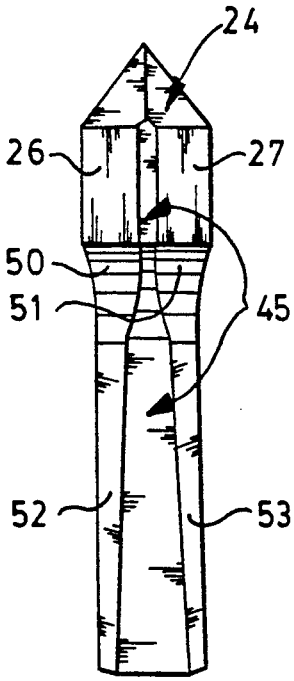
FIG. 10 is a radial view of the die tooth of FIG. 7.

To eliminate the detrimental effects of no die tooth thickness relief between form and root diameters, and to redirect the bending forces at the leading transition section 41 (see FIGS. 7-10), this invention features removal of that entire root-to-pitch diameter of the die tooth crest material by scalloping the region at 44 adjacent to the lands 26, 27 with a large circle radius 42 (curvilinear relief) blended tangentially to a nominal 3° straight taper 43 (linear relief) as illustrated in FIGS. 7, 8, and 9. This drastic introduction of die tooth relief is to totally remove the questionable under-relieved area at the tooth crest and thereby redirect the otherwise poorly positioned bending stresses from the thin, failure prone crest 45 of the die tooth to the stronger base 20 of the tooth while at the same time maintaining adequate helical workpiece guidance, dimensional control, and surface integrity of all extruded elements. As a result, the dedendum forming means, including the crest, will have a crest width 46 at the lands of about 0.06", a crest width 47 at the curvilinear relief of about 0.08", and a crest width 48 at the exit of the tooth of about 0.15". The base adjacent the curvilinear relief is comprised of a first planar transition surface 50 which intersects with the land 26 and is inclined inwardly away from the land and toward the body of the tooth. Similarly, a second planar transition surface 51 intersects land 27 and is inclined inward away from the land toward the body of the tooth. These transition surfaces intersect other planar flanks 52 and 53, respectively, which are located on the drive and trail sides of the tooth body. Transition surfaces 50 and 51 have a component of length directed inwardly from the respective lands approximately 0.002" and have a component along the length of the tooth of approximately 0.40". Each land 26 and 27 extends along the length of the tooth approximately 0.10". The planar surfaces 52 and 53 are inclined inward toward the line B of the tooth at a slope of approximately 0.0025" per inch of tooth length.

I claim:

1. A die for forming helical externally toothed gears, comprising:

a body having a cylindrical inner surface provided with generally longitudinally extending, helically arranged die teeth circumferentially indexed apart, each tooth having (i) a leading ramp portion, (ii) a profile forming region, and (iii) a downstream tooth region, said profile forming region having an aspect ration greater than 1.5, said downstream tooth region having involuted side flanks joined by a tooth crest, said crest following the helix and being radially inwardly and curvilinearly relieved with respect to said profile forming region to eliminate concentrated bending stresses while maintaining helical workpiece guidance, dimensional control, and surface integrity.

2. The die as in claim 1, in which said profile forming region has involuted side flanks joined by an unrelieved crest.

3. The die as in claim 1, in which the leading portion of said downstream tooth region region is scalloped with a spherical radius and the trailing portion of the downstream tooth region is flat but linearly relieved and tangent to said spherical radius.

4. A hollow die for extruding externally helically toothed cylindrical members, comprising a hollow die body having a cylindrical inner surface concentric about a central axis, convolutions indented in said inner surface to form a series of circumferentially spaced helical teeth effective to form mirror image teeth on a member forced axially through said die, each tooth having:

(a) a base with its longitudinal extent angled with respect to said central axis to achieve a helix, said base forming the major tooth diameter for a tooth of the member to be extruded;

(b) an entry end face for each of said die teeth to facilitate feeding of the member through said die; and (c) a body extending radially inwardly from said base and downstream from said entry end face having a profile forming region and a downstream tooth region, said profile forming region having an aspect ration greater than 1.5, said downstream tooth region following the helix, and having a crest relieved, with respect to said profile forming region, first with a curvilinear surface and secondly with a linear surface tangent to said curvilinear surface.

5. The die as in claim 4, in which said curvilinear surface has a spherical radius.

6. The die as in claim 4, in which said crest broadens out as it increasingly is relieved.

7. The die as in claim 4, in which the width of said crest at the termination of the linear surface is about 0.15".

8. The die as in claim 4, in which the major diameter of the member to be extruded by such die is about 1.250".

9. The die as in claim 4, in which the axial length of said profile forming region is in the range of 0.10".

10. The die as in claim 4, in which the base and crest of said convolutions have a helix angle in the range of 20°-25°.

11. The die as in claim 4, in which said convolutions are spaced apart with respect to each other a distance in the range of 0.20".

12. The die as in claim 4, in which said downstream tooth region has side flank surface with an involute curvature.

13. A method of making an extruded helical externally-toothed gear, comprising the steps of:

(a) forming an internally toothed extruding die with helical die teeth, each tooth having a tooth region downstream from a dedendum forming section, said downstream tooth region being curvilinearly relieved to about the pitch diameter of the tooth, said curvilinear relief being adjacent the dedendum formed region, and linearly relieved the more remote the section is from the curvilinear relief;

(b) forcing a blank through said extrusion die to a semi-completed stage, said extrusion die being effective to redirect extrusion forces on the die teeth downstream of the entry and land region where full tooth height is formed in the blank, said redirection being immediately close to the base of each tooth and progressively more close to the base the more remote the die tooth section is from the land region;

(c) using a second blank to force the semi-completed first blank completely through the extrusion die; and (d) machining away any lips created at the entrance or exit ends of said teeth as a result of extrusion.

* * * * *